US012427567B2

(12) United States Patent
Brullot et al.

(10) Patent No.: US 12,427,567 B2
(45) Date of Patent: Sep. 30, 2025

(54) CONTINUOUS CASTER TO CAST A METAL PRODUCT

(71) Applicant: ArcelorMittal, Luxembourg (LU)

(72) Inventors: Thomas Brullot, Rombas (FR); Thomas Lavalard, Metz (FR); Jean-Marc Hemmen, Verny (FR); Jean-Noël Fouligny, Norroy-les-pont-à-Mousson (FR)

(73) Assignee: ArcelorMittal, Luxembourg (LU)

( * ) Notice: Subject to any disclaimer, the term of this patent is extended or adjusted under 35 U.S.C. 154(b) by 70 days.

(21) Appl. No.: 18/543,940

(22) Filed: Dec. 18, 2023

(65) Prior Publication Data

US 2024/0149333 A1 May 9, 2024

Related U.S. Application Data

(62) Division of application No. 17/299,387, filed as application No. PCT/IB2018/060031 on Dec. 13, 2018, now Pat. No. 11,883,877.

(51) Int. Cl.

| | |
|---|---|
| ***B22D 11/20*** | (2006.01) |
| ***B22D 11/16*** | (2006.01) |
| ***B22D 11/22*** | (2006.01) |

(52) U.S. Cl.

CPC ..... *B22D 11/207* (2013.01); *B22D 11/16* (2013.01); *B22D 11/22* (2013.01); *B21B 2201/14* (2013.01)

(58) Field of Classification Search

CPC ..... B22D 11/163; B22D 11/18; B22D 11/188; B22D 11/20; B22D 11/207

See application file for complete search history.

(56) References Cited

U.S. PATENT DOCUMENTS

| | | | |
|---|---|---|---|
| 2010/0163206 | A1 | 7/2010 | Iizuka et al. |
| 2018/0161831 | A1 | 6/2018 | Wang et al. |
| 2018/0161861 | A1 | 6/2018 | Martin et al. |

FOREIGN PATENT DOCUMENTS

| | | | |
|---|---|---|---|
| CN | 2858122 | | 1/2007 |
| CN | 1909995 | | 2/2007 |
| CN | 101035639 | A | 9/2007 |
| CN | 101890488 | | 11/2010 |
| CN | 102310181 | | 1/2012 |
| EP | 1707290 | A1 | 10/2006 |
| EP | 3251774 | A1 | 12/2017 |
| JP | S 5466333 | A | 5/1979 |
| JP | H09225611 | A | 9/1997 |
| JP | 2006289378 | A | 10/2006 |

(Continued)

OTHER PUBLICATIONS

See Search Report of PCT/IB2018/060031 dated Dec. 4, 2019.
Machine Translation of CN 101890488 A (Year: 2010).

*Primary Examiner* — Kevin E Yoon
*Assistant Examiner* — Jacky Yuen
(74) *Attorney, Agent, or Firm* — Davidson Kappel LLC

(57) ABSTRACT

A continuous caster to cast a metal product has a plurality of upper and lower segment frames bearing rolls, the upper and lower segment frames being located respectively above and below the cast metal product. At least one bending measurer is located on at least one of the upper segment frames and able to emit a bending measurement signal indicative of a bending of the at least one of the upper segment frames. A processor is disposed to receive the bending measurement signal and to calculate a location Pmes of the crater end based on the measured bending signal, the crater end location being the location.

6 Claims, 3 Drawing Sheets

(56) References Cited

FOREIGN PATENT DOCUMENTS

| | | | |
|---|---|---|---|
| JP | 2012 110947 | A | 6/2012 |
| JP | 2012245527 | | 12/2012 |
| JP | 2013 123739 | A | 6/2013 |
| JP | 2013111624 | A | 6/2013 |
| JP | 2014028399 | A | 2/2014 |
| JP | 5835574 | B2 | 12/2015 |
| JP | 6 319179 | B2 | 5/2018 |
| KR | 2003-0052569 | | 6/2003 |
| WO | WO 2014006195 | A1 | 1/2014 |

CONTINUOUS CASTER TO CAST A METAL PRODUCT

This is a Divisional of U.S. patent application Ser. No. 17/299,387, filed Jun. 3, 2021 which is a National Phase of PCT/162018/060031, filed on Dec. 13, 2018. All of the above are hereby incorporated by reference herein.

The invention deals with a method to determine the crater end location of a cast metal product, to a method of casting of a metal product and to a continuous caster.

A continuous casting machine 11, or continuous caster, as illustrated in FIG. 1, comprises a tundish 12 for receiving molten metal from a ladle, a mold 13 for receiving a flow of the metal from the tundish and forming the metal into a cast product 1, such as a slab, and a plurality of rolls 14 for transporting and/or forming the metal product as it solidifies. The slab 1 has a molten core as it leaves the mold and this core solidifies as the slab is conveyed by the rolls along a travel path to an output end 15, where the slab is cut-off or otherwise further processed. The moment at which the slab is fully solidified is called the crater end 16 or solid pool end.

Knowing the location of the crater end is essential for the proper working of the casting installation. Indeed, if the slab is not fully solidified when it leaves the installation, it can cause the stoppage of the casting installation due to an important bulging of the product. Moreover, as this crater end location depends mainly on the casting process parameters and notably on the casting speed, by knowing the crater end location it is possible to accurately monitor the casting speed and so to increase productivity. This is also important to apply the so-called dynamic soft reduction method which consists in applying a defined pressure on the strand depending on its solidification state so as to reduce the central segregation and porosity of the cast slab.

BACKGROUND

Document US 2018 0161831 A1 describes a monitoring method wherein pair of load sensors are located on or within a housing of one of the two bearings supporting each one of the rolls so as to calculate a difference between load of adjacent rolls. Once this difference is below a threshold value, the crater end is reached. This method implies to introduce the sensors only when there is a change of the rolls and if a sensor is out of order it is necessary to stop the installation and to remove a full segment so as to replace the concerned roll and sensor.

Document JP 2013 123739 A describes a method in which a displacement sensor is placed on the entry and exit side of at least one upper segment supporting the rolls and measure the displacement of said segment when the strand travels under. When the measured displacement is upper or equal to 0.1 mm the strand is considered as fully solidified. This method is not accurate, a displacement of 0.1 mm being difficult to detect and is easily impacted by the defects in the product, notably flatness defects.

Document JP 09 225611 A describes a method in which the crater end is detected by sticking a strain gauge at the lower end of a roll chock. This method implies to introduce the sensors only when there is a change of the rolls and if a sensor is out of order it is necessary to stop the installation and to remove a full segment so as to replace the concerned roll and sensor.

SUMMARY OF THE INVENTION

It is an object of the present invention to provide a method to determine the crater end location of a cast metal product which is accurate and which can be easily implemented on stand while not requiring a high level of maintenance.

The present invention provides a method to determine the crater end location of a cast metal product during its casting, said crater end location being the location at which the cast metal product becomes fully solidified, said method comprising the step of:

a. Casting molten metal in a continuous casting machine comprising several upper and lower segment frames, which bear rolls, that are located respectively above and below the cast metal product,
b. Estimating the location $P_{est}$ within the continuous casting machine at which the metal product becomes fully solidified,
c. At least measuring the bending of the nearest upper segment frame of the estimated location $P_{est}$,
d. Calculating the location $P_{mes}$ of the crater end based on said measured bending.

The method according to the invention may also comprise the following optional characteristics considered separately or according to all possible technical combinations:

- the bending is measured at least on the two ends of the nearest upper segment frame.
- the estimation of the location $P_{est}$ within the continuous casting machine at which the metal product becomes fully solidified is performed with a model.

The invention is also related to a method of casting a metal product at a casting speed S, said casting speed S being monitored according to the crater end location as determined by a method as previously described. The monitoring of the casting speed S may be done so as to minimise the distance between the crater end location and the output end of the continuous casting machine. The casting of the metal product may comprise the application of a dynamic soft reduction to the metal product and the casting speed is monitored so that said dynamic soft reduction is applied to the metal product before the crater end position is reached.

The invention is also related to a continuous caster to cast a metal product, said continuous caster comprising:

- several upper and lower segment frames, which bear rolls, that are located respectively above and below the cast metal product,
- at least one bending measurement means located on at least one upper segment frame and able to emit a bending measurement signal,
- a processor able to receive said bending measurement signal and to calculate the location $P_{mes}$ of the crater end based on said measured bending signal, said crater end location being the location at which the cast metal product becomes fully solidified.

The continuous caster according to the invention may also comprise the following optional characteristics considered separately or according to all possible technical combinations:

- the bending measurement means is a gauge sensor.
- at least one upper frame is equipped with at least two bending measurement means, respectively positioned on each of its ends.

BRIEF DESCRIPTION OF THE DRAWINGS

Other characteristics and advantages of the invention will appear at the reading of the following description.

In order to illustrate the invention, trials have been performed and will be described by way of non-limitative examples, notably in reference to figures which represent.

DETAILED DESCRIPTION

Figure 1:
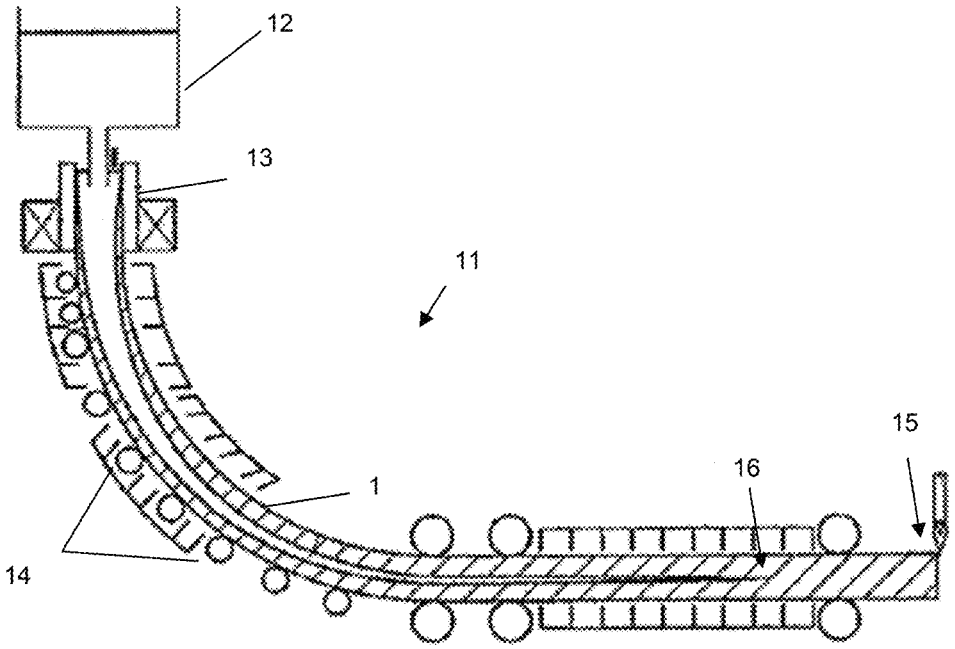
FIG. 1 illustrates a casting machine, or caster
Figure 2:
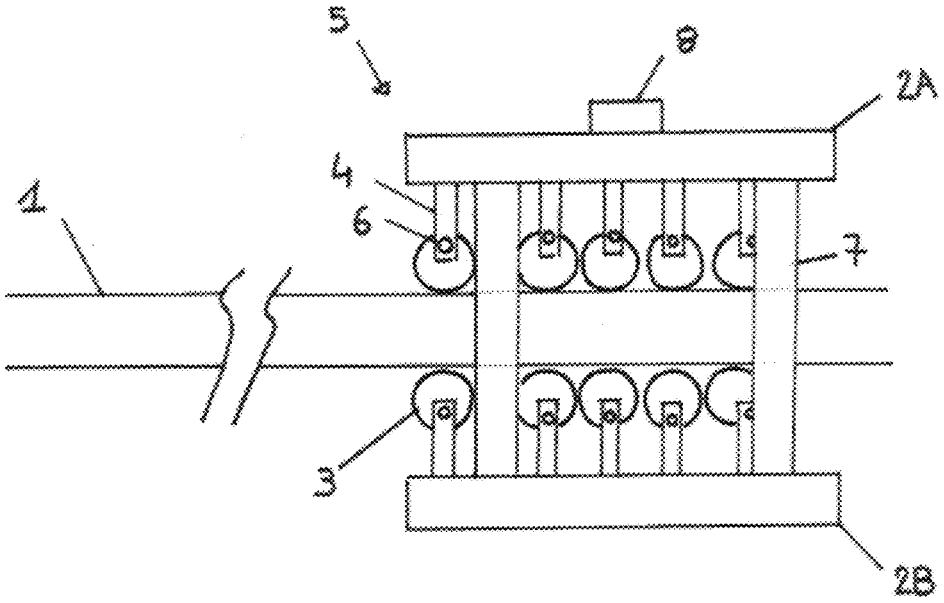
FIG. 2 illustrates a segment of a caster

FIG. 2 describes a segment 5 of a continuous caster to cast a metal product 1. The metal product 1 goes between an upper 2A and a lower 2B segment frame, each segment frame 2A, 2B bearing rolls 3. Each roll 3 is connected to the segment frames 2A, 2B through a roll shock 4 and a bearing 6 which makes the junction between the roll shock 4 and the roll 3. Upper and lower segment frames 2A, 2B are connected to each other by beams 7. In a method according to the invention for each new product cast, for example for each new steel grade and/or each time the casting speed is changed, the location $P_{est}$ of the crater end, i.e. the point at which the cast product becomes fully solidified, is estimated. This estimation may be done for example by using Abaqus, statistic or physical models. The bending of the nearest upper segment frame 2A of this estimated location is then measured. This measurement may be done by a strain gauge, an extensometer or any other appropriate bending measurement means 8. The bending measurement means 8 may be placed on the external surface of the upper segment frame 2A as illustrated in FIG. 2. It may be glued or welded to the segment frame. In a preferred embodiment the bending measurement is performed at the entry and the exit of the segment frame 2A, the entry being the side where the strand first goes between the rolls and the exit being the opposite side where the strand leaves the segment. When the estimated location of the crater end is between two segments, the bending measurement is performed on both segments. When the range of cast product or the casting speed variation is broad, measurement means are installed on several upper segment frames so as to be able to measure bending in all configurations without necessity to add or displace measurement means for each new casting campaign. The principle of this measurement is based on the fact that when the product state changes, from a mushy to a solid state, the load applied by the metal product on the segment's rolls change due to the reduction or the increase of the ferrostatic pressure. This explains why prior art methods were focused on measurements at the roll level, but the inventors discovered that this load variation is transmitted to the segment frame and in sufficient proportion to be measured by an appropriate sensor. As a matter of illustration, a segment frame is made of a volume of 1 $m^3$ of pig iron.

Once the bending is measured it is possible to calculate the location $P_{mes}$ of the crater end based on said bending. When only one bending measurement is performed the measured signal can be compared with a predefined value of bending in a mushy state, if the measured bending is below said value it means that the load applied to the segment frame is lower than expected in a mushy state and so that the metal product is already solidified. The crater end is thus located before the bending measurement means location. If the measured bending is above or equal to the predefined value it means the crater end is located after said measurement mean. Depending on the difference between the bending measured value and the predefined value it is possible to calculate the distance between the position of the sensor and the crater end location.

Figure 3:
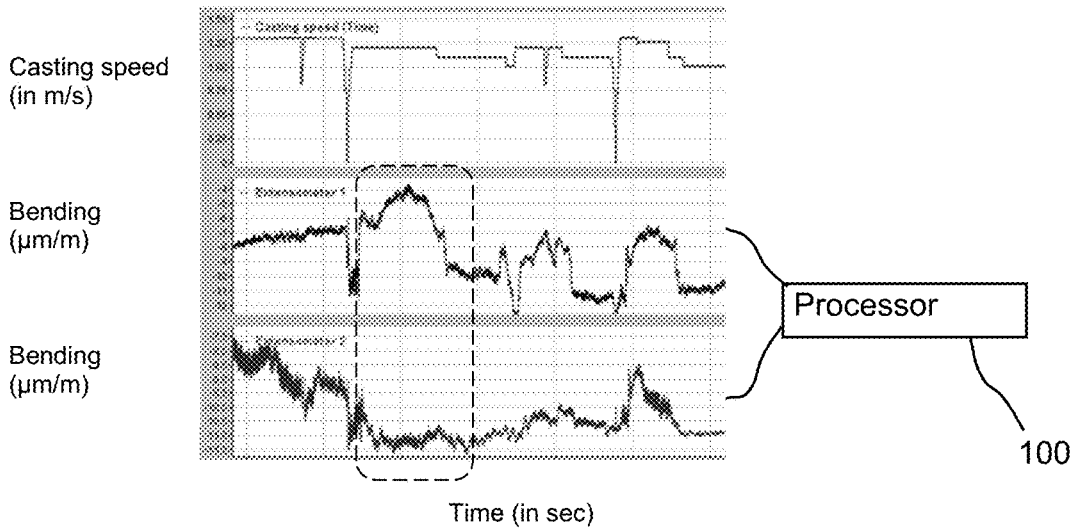
FIG. 3 is a set of three curves representing the casting speed and the bending measurement performed by two bending measurement means

When several bending measurement means are used it is possible to compare the bending measured by each one, the crater end being located between the two positions of the measurement sensors having the biggest bending variations in their respective signals. This is illustrated in FIG. 3. In this example, the signals of two bending measurement means which are extensometers are represented in function of the casting speed. These two extensometers were installed on an upper segment frame, respectively at the entry and at the exit of said segment. Looking at the signal in the dotted frame, for the given casting speed, the extensometer 1 "sees" a mushy product, bending is high, while the extensometer 2 "sees" a solid product, bending is low. The crater end location is consequently between the positions of those two bending measurement means.

By multiplying the casting speed variations and calculation of the crater end location with a method and processor 100 (shown schematically in FIG. 3 receiving signals from the two extensometers 1, 2) according to the invention it is possible to accurately determine for a given grade and a given thickness of the solidified slab what is the maximum casting speed allowed to have the crater end and so the full solidification of slab within the caster. This is illustrated in FIG. 4.

Figure 4:
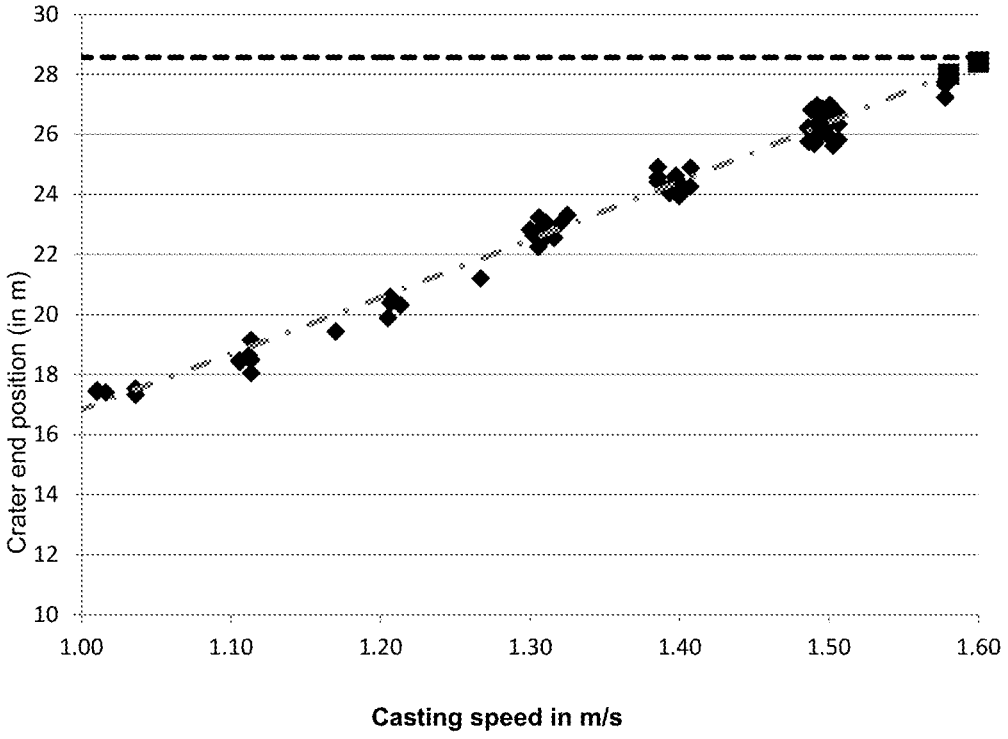
FIG. 4 illustrates results which may be obtained by using a method according to the invention

FIG. 4 represents the crater end location determined with a method according to the invention in function of the casting speed. In practice, the method according to the invention was performed several times for a given casting speed and then said casting speed was increased, crater end position determined, and so on until the crater end location almost reaches the output end of the casting machine so as to avoid any damage. The dotted line is the maximum length of the caster, i.e. the output end 15, and length zero being the tundish exit. As can be seen on the graph, for this given metal product the maximum speed allowable to have the crater end within the caster is of 1.60 m/s. Knowing this maximum speed allows to increase the productivity of the caster.

Using a method according to the invention it is possible to accurately and robustly detect the crater end location. Indeed, the measurement being performed on the upper segment frame, the measurement means are positioned on said frames and may perform the measurement as long as they work and there is no need to wait for a caster stop and part replacement to replace a defective sensor.

What is claimed is:

1. A continuous caster to cast a metal product, the continuous caster comprising:

a plurality of upper and lower segment frames bearing rolls, the upper and lower segment frames being located respectively above and below the cast metal product;

at least one bending measurer located on at least one of the upper segment frames and able to emit a bending measurement signal indicative of a bending of the at least one of the upper segment frames;

a processor disposed to receive the bending measurement signal and to calculate a location Pmes of the crater end based on the measured bending signal, the crater end location being the location where the cast metal product becomes fully solidified.

2. The continuous caster as recited in claim 1 wherein the bending measurer is a gauge sensor.

3. The continuous caster as recited in claim 1 wherein the at least one bending measurer includes two bending measurers respectively positioned on each of end of the at least one upper segment frame.

4. The continuous caster as recited in claim 1 wherein the caster performs a method including the steps of: casting molten metal in the continuous caster; estimating a location Pest within the continuous caster where the metal product becomes fully solidified; at least measuring the bending of the nearest upper segment frame of the estimated location Pes, wherein the bending is measured at least on two ends of the nearest upper segment frame; and calculating the location Pmes of the crater end based on the measured bending.

5. The continuous caster as recited in claim 4 wherein the bending measurer is a gauge sensor.

6. The continuous caster as recited in claim 4 wherein the at least one bending measurer includes two bending measurers respectively positioned on each of end of the at least one upper segment frame.

* * * * *